US009587336B2

(12) United States Patent
Lee et al.

(10) Patent No.: US 9,587,336 B2
(45) Date of Patent: Mar. 7, 2017

(54) WASHING MACHINE

(71) Applicant: LG ELECTRONICS INC., Seoul (KR)

(72) Inventors: Kyubum Lee, Seoul (KR); Youngjong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 576 days.

(21) Appl. No.: 13/910,687

(22) Filed: Jun. 5, 2013

(65) Prior Publication Data

US 2013/0319056 A1 Dec. 5, 2013

(30) Foreign Application Priority Data

Jun. 5, 2012 (KR) ..... 10-2012-0060405
Jun. 5, 2012 (KR) ..... 10-2012-0060406

(51) Int. Cl.
*D06F 17/10* (2006.01)
*D06F 39/10* (2006.01)

(52) U.S. Cl.
CPC ..... *D06F 17/10* (2013.01); *D06F 39/10* (2013.01)

(58) Field of Classification Search
CPC ..... D06F 37/06; D06F 37/08; D06F 37/10; D06F 39/10; D06F 13/00; D06F 13/02; D06F 13/06; D06F 13/08
See application file for complete search history.

(56) References Cited

U.S. PATENT DOCUMENTS 5,595,072 A 1/1997 Bai et al.
2003/0200774 A1 10/2003 Kim et al.

FOREIGN PATENT DOCUMENTS

CN 1240851 A 1/2000
CN 1451803 A 10/2003
KR 20-0127329 Y1 12/1998
KR 10-2001-0037217 A 5/2001
KR 10-2011-0009536 A 1/2011

OTHER PUBLICATIONS

Machine Translation of Kim, KR 10-2001-0037217, May 2001.*

* cited by examiner

*Primary Examiner* — David Cormier
(74) *Attorney, Agent, or Firm* — Dentons US LLP

(57) ABSTRACT

Provided is a washing machine. The washing machine includes a tub, a drum, a pulsator, a water stream generation unit, a filter cap, and a check valve. The tub contains washing water. The drum is rotatably disposed in the tub and receiving laundry. The pulsator is rotatably disposed inside the drum and has a spouting outlet. The water stream generation unit is disposed under the pulsator and forms a water stream spouted through the spouting outlet by circulating washing water contained between the tub and the drum. The filter cap collects foreign substances floating in washing water spouted through the spouting outlet. The check valve opens the spouting outlet by the water stream formed by the water stream generation unit.

21 Claims, 8 Drawing Sheets

WASHING MACHINE

This application claims priority to Korean Patent application no. 10-2012-0060405 filed Jun. 5, 2012 and no. 10-2012-0060406 filed Jun. 5, 2012 which is hereby incorporated by reference.

BACKGROUND OF THE INVENTION

1. Field of the Invention

The present invention relates to a washing machine.

2. Description of the Related Art

Generally, a washing machine forcedly stirs washing targets by forming a water stream using a mechanical force of a pulsator rotated by a driving motor when detergents, washing water, and washing targets are loaded in a drum. Thus, washing can be performed by a physical action such as friction or impact between washing targets. Also, washing can be performed by a chemical action between detergents and washing targets. Furthermore, floating of washing targets in the drum promotes the chemical action of detergents.

The pulsator is rotated by the driving motor, and can form various water streams in the drum through normal/reverse rotation. Furthermore, in order to strengthen the water stream, a unit for spouting a water stream from the pulsator may be provided.

The spouting of the water stream through the pulsator can be implemented by various methods. As an example, there is a method of forming a water stream by a centrifugal force of the pulsator and spouting the water stream. However, in this case, since the water stream is spouted while having a whirling characteristic, it is difficult to secure a sufficient spouting pressure.

Meanwhile, there is a method of spouting a water stream by adding a separate fan to the pulsator. However, the structure of the pulsator can be complicated, and the whirling characteristic of the water stream still remains.

In either case, since washing water flows while circulating between the pulsator and the drum, foreign substances such as contaminants or lint from washing targets increases as time goes on. When foreign substances are appropriately removed, clogging of the flow path of washing water and recontamination of washing targets can occur.

SUMMARY OF THE INVENTION

The present invention provides a washing machine which can collect foreign substances floating in washing water when a water stream is spouted through a pulsator.

The present invention also provides a washing machine which can reduce abrasion of the laundry while using a small amount of washing water by forming a water stream with a strong spouting pressure and thus maintaining the balance of the water level of washing water inside a drum.

The present invention also provides a washing machine which can untangle twisted laundry using a water stream spouted from a pulsator.

The present invention also provides a washing machine which can improve the washing performance by forming a water stream with a strong spouting pressure and thus facilitating the circulation of detergents put into a drum.

According to an aspect of the present invention, there is provided a washing machine comprising: a tub containing washing water; a drum rotatably disposed in the tub and receiving laundry; a pulsator rotatably disposed inside the drum and having a spouting outlet; a water stream generation unit disposed under the pulsator and forming a water stream spouted through the spouting outlet by circulating washing water contained between the tub and the drum; a filter cap collecting foreign substances floating in washing water spouted through the spouting outlet; and a check valve opening the spouting outlet by the water stream formed by the water stream generation unit.

According to another aspect of the present invention, there is provided a washing machine comprising: a tub containing washing water; a drum rotatably disposed in the tub and receiving laundry; a pulsator rotatably disposed inside the drum and having a spouting outlet at a central portion thereof; a centrifugal blade unit rotatably disposed under the pulsator and spouting washing water introduced between the tub and the drum by a centrifugal force due to a rotation; and a guide unit disposed independently of a rotation of the centrifugal blade unit to guide washing water spouted by the centrifugal blade unit to the spouting outlet of the pulsator.

The foregoing and other objects, features, aspects and advantages of the present invention will become more apparent from the following detailed description of the present invention when taken in conjunction with the accompanying drawings.

BRIEF DESCRIPTION OF THE DRAWINGS

Embodiments will be described in detail with reference to the following drawings in which like reference numerals refer to like elements, and wherein.

DETAILED DESCRIPTION OF THE INVENTION

Figure 1:
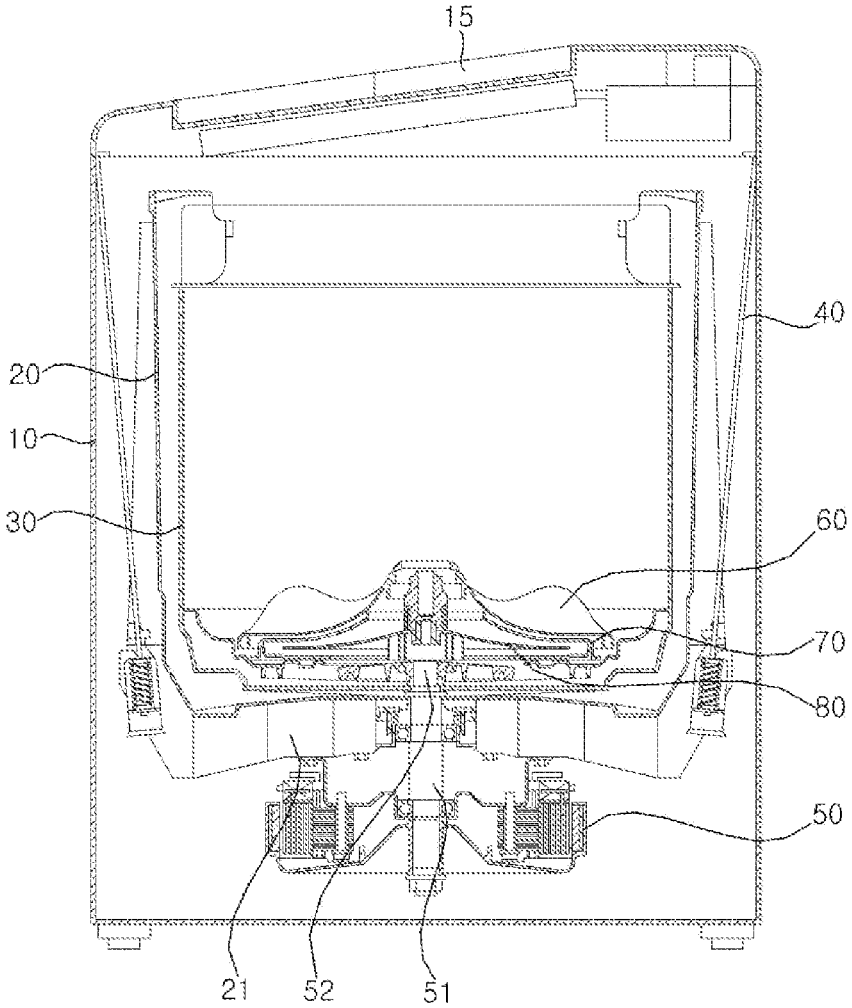
FIG. 1 is a cross-sectional view illustrating a washing machine according to an embodiment of the present invention.

The foregoing and other objects, features, aspects and advantages of the present invention will become more apparent from the following detailed description of the present invention when taken in conjunction with the accompanying drawings. Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions may be exaggerated for clarity, and the same reference numerals will be used throughout to designate the same or like components.

Figure 2:
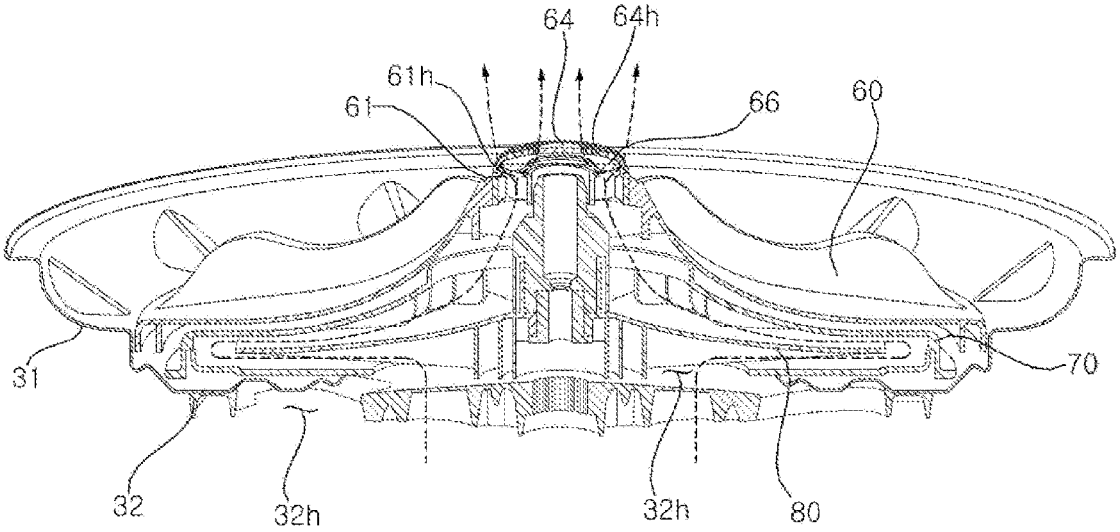
FIG. 2 is a view illustrating components involved in spouting a water stream through a pulsator, which is a magnified view illustrating a portion of the washing machine of FIG. 1.
Figure 3:
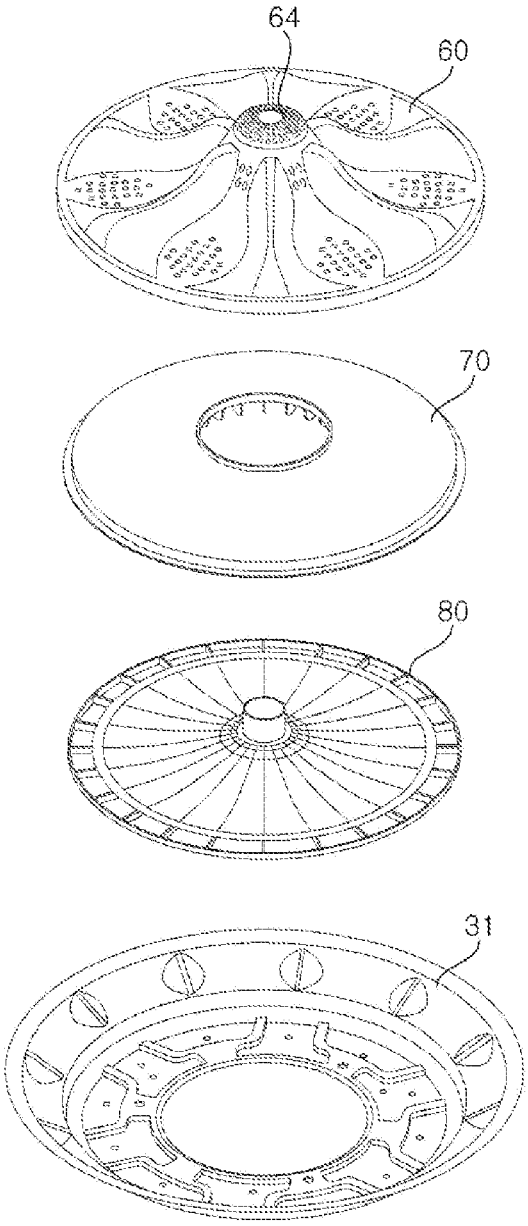
FIG. 3 is an exploded perspective view illustrating the components shown in FIG. 2.
Figure 4:
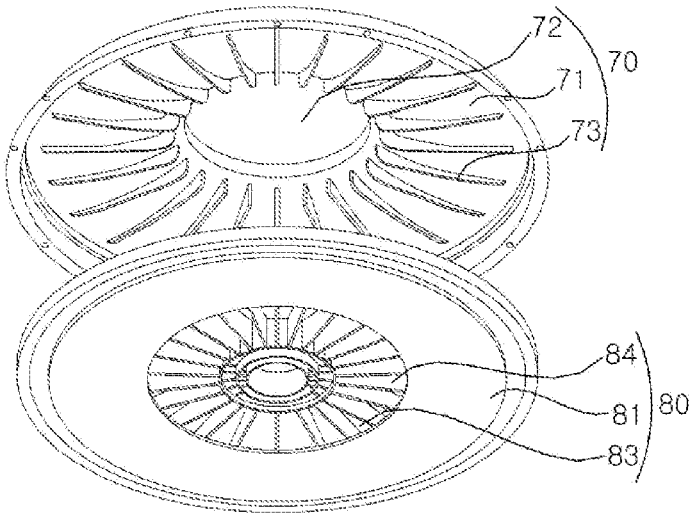
FIG. 4 is a view illustrating a portion of the components of FIG. 3 when viewed from the bottom.
Figure 5:
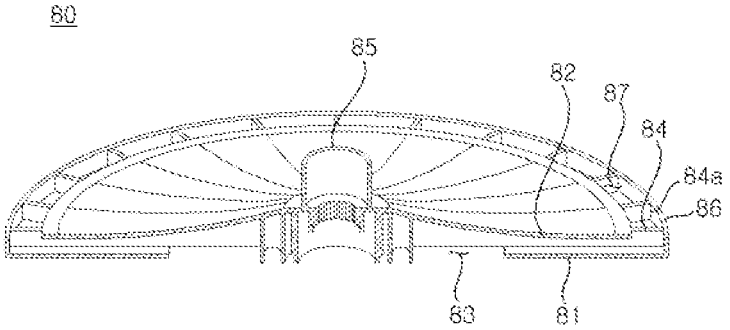
FIG. 5 is a cross-sectional view illustrating a centrifugal blade unit of FIG. 4.
Figure 6:
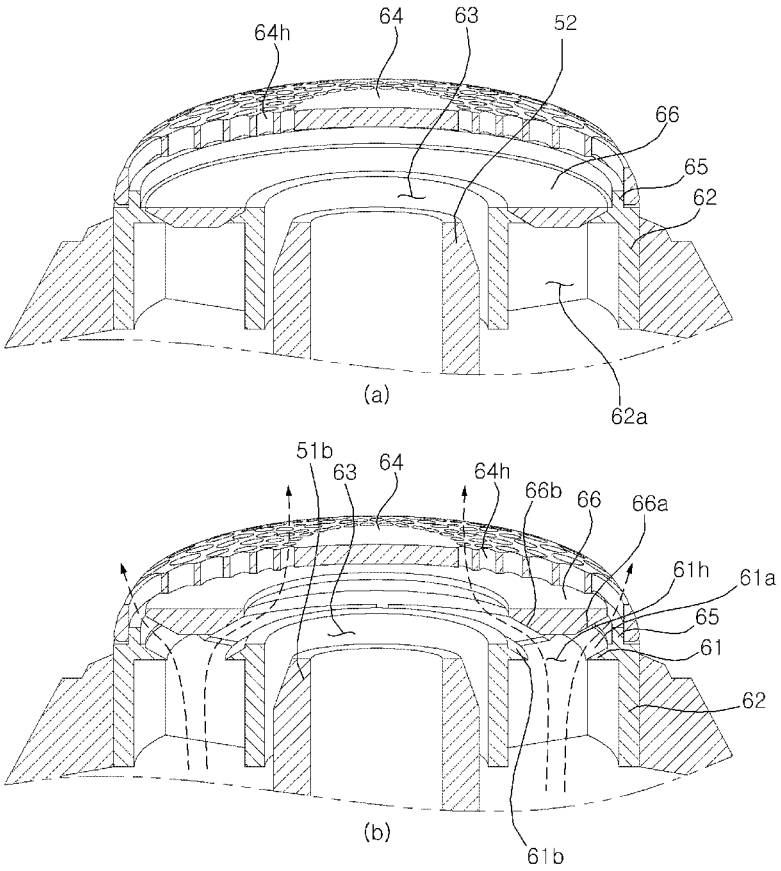
FIG. 6 is a partially magnified view of FIG. 2, which illustrates a state (a) that a spouting outlet of a pulsator is closed by a check valve and a state (b) that the spouting outlet of the pulsator is opened by the check valve.

FIG. 1 is a cross-sectional view illustrating a washing machine according to an embodiment of the present invention. FIG. 2 is a view illustrating components involved in spouting a water stream through a pulsator, which is a magnified view illustrating a portion of the washing machine of FIG. 1. FIG. 3 is an exploded perspective view illustrating the components shown in FIG. 2. FIG. 4 is a view illustrating a portion of the components of FIG. 3 when viewed from the bottom. FIG. 5 is a cross-sectional view illustrating a centrifugal blade unit of FIG. 4. FIG. 6 is a partially magnified view of FIG. 2, which illustrates a state (a) that a spouting outlet of a pulsator is closed by a check valve and a state (b) that the spouting outlet of the pulsator is opened by the check valve.

Referring to FIGS. 1 and 2, a washing machine according to an embodiment of the present invention may include a main body 10 or cabinet defining the exterior of the washing machine, a tub 20 disposed inside the main body 10, and a drum 30 rotatably disposed inside the tub 20.

The main body 10 may form the exterior of the washing machine, and may have a cuboidal box shape. However, the shape of the main body 10 is merely an example, and is not limited to the cuboidal shape as long as the main body 10 can form the exterior.

A door 15 may be provided on an upper portion of the main body 10 to load and unload the laundry. The tub 20 may be filled with washing water, and may be suspended in the main body 10 by a suspension bar 40.

The drum 30 may be loaded with the laundry, and may be rotatably disposed in the tub 20. A pulsator 60 may be rotatably disposed on a lower portion of the drum 30.

A driving motor 50 may provide a torque for rotating the drum 30 and/or the pulsator 60. The driving motor 50 may be disposed under the tub 20. Hereinafter, the driving motor 50 will be exemplified as a direct driving type in which the shaft of the driving motor 50 is aligned with the rotation center of the drum 30 or the pulsator 60 on a same axis to directly deliver a torque to the drum 30 and/or the pulsator 60, but without being limited thereto, the driving motor 50 can be implemented by an indirection driving type in which the torque of the driving motor 50 is delivered to the drum 30 and/or the pulsator 60 through a power transmission member such as a belt or a pulley.

The driving motor 50 may include a core and a rotor that is rotated by an induced electromotive force interacting with the core. Due to the rotation of the rotor, a washing shaft 52 for rotating the pulsator 60 and a spinning shaft 51 for rotating the drum 30 can be rotated. While the rotor and the washing shaft 52 are integrally rotated at all times, the rotation of the spinning shaft 51 may be performed by manipulating a clutch (not shown) that transmits the torque of the rotor. The clutch may be selectively engaged with the rotor by moving upward and downward, thereby delivering the torque of the rotor to the spinning shaft 51.

A pulsator 60 may be rotatably disposed inside the drum 30. The pulsator may include a plurality of wings to form a water stream by the rotation of the pulsator 60. The pulsator 60 may have a spouting outlet 61*h* at the central portion thereof to spout a water stream generated by a water stream generation unit into the drum 30. The water stream generation unit may be disposed under the pulsator 60, and may circulate washing water contained between the tub 20 and the drum 30 and then spout washing water through the spouting outlet 61*h*.

The water stream generation unit may be rotatably disposed under the pulsator 60, and may include a centrifugal blade unit 80 and a guide unit 70. The centrifugal blade unit 80 may spout washing water introduced between the tub 20 and the drum 30 by a centrifugal force during the rotation. The guide unit 70 may be disposed independently of the rotation of the centrifugal blade unit 80, and may guide washing water spouted by the centrifugal blade unit 80 to the spouting outlet 61*h* of the pulsator 60.

Foreign substances floating in washing water spouted from the spouting outlet 61*h* may be collected by a filter cap 64. The filter cap 64 may have a plurality of through holes 64*h* formed therein. While washing water spouted through the spouting outlet 61*h* is passing through the through hole 64*h*, foreign substances having a larger size than the through hole 64*h* may be filtered.

Referring to FIGS. 4 to 6, the pulsator 60 may include a flow passage forming portion 62 for forming a flow passage 62 that guides washing water forcedly sent by the water stream generation unit, i.e., washing water discharged through a discharge port 72 of the guide unit 70 to the spouting outlet 61*h* of the pulsator 60.

A check valve may open the spouting outlet 61*h* by the water stream generated by the action of the water stream generation unit. That is, during the rotation of the centrifugal blade unit 80, a water stream guided along the flow passage 62 may be formed, and thus the check valve may be opened by a water pressure applied by the water stream. The check valve may be implemented in various manners. In this embodiment, the check valve 66 may be vertically movably disposed in the filter cap 64, closing the spouting outlet 61*h* at the falling location and opening the spouting outlet 61*h* at the rising location due to the water pressure. The check valve 66 needs to close the spouting outlet 61*h* while the centrifugal blade unit 80 is not rotating, and also needs to close the spouting outlet 61*h* when washing water is introduced into the filter cap 64 through the through hole 64*h* of the filter cap. Accordingly, the check valve 66 needs to have a greater specific gravity than washing water, and may be formed of a flexible material so as to be smoothly seated on a seating groove 61 described later, particularly, upon falling operation. However, the check valve 66 is not limited to such a configuration, and may be implemented in other types. For example, the check valve 66 may be disposed to be rotatable in the filter cap 64 so as to open/close the spouting outlet 61*h* according to the water pressure.

Referring again to FIG. 6, the pulsator 60 may be provided with a hub 63 at the central portion thereof. The hub 63 may receive the washing shaft 52 among the driving shafts of the driving motor 50. The flow passage 62*a* formed inside the flow passage forming portion 62 may form a ring shape extending along the circumference of the hub 63. Accordingly, the spouting outlet 61*h* that is the outlet of the flow passage 62*a* may also have a ring shape similarly to the flow passage 62*a*.

The flow passage forming portion 62 may be provided with the seating groove 61, on which the check valve 66 is seated, around the spouting outlet 61*h*. The check valve 66 may be seated on the seating groove 61 at the falling location, thereby being limited in its movement and stably closing the spouting outlet 61*h*. Particularly, the check valve 66 may have an outer inclination surface 66*a* along the outer circumference that is seated in the seating groove 61, and the seating groove 61 may have an outer seating surface 61*a* corresponding to the outer inclination surface 661*a*. Particularly, in addition to the outer inclination surface 66*a*, the check valve 66 may further have an inner inclination surface 66*b* along the inner circumference, i.e., the circumference of the opened central portion of the check valve 66. In this case, the seating groove 61 may also have an inner seating surface 61*b* corresponding to the inner inclination surface 66*b*. Particularly, since the outer inclination surface 66*a* and the inner inclination surface 66*b* incline toward opposite directions to each other, the check valve 66 can be smoothly inserted into the seating groove 61 upon falling operation, and the spouting outlet 61*h* can be more reliably closed.

The filter cap 64 may be detachably coupled to the pulsator 60, particularly, the flow passage forming portion 62. For example, the filter cap 64 and the flow passage forming portion 62 may be coupled to each other by hook coupling or mutual fit coupling (In this embodiment, a fit protrusion 65 may be provided on the pulsator 60 to be coupled to the filter cap 64). In this case, the filter cap 64 can be separated by a certain level of force, or can be fastened or unfastened by a turning operation, but the present invention is not limited thereto. When a certain amount of foreign substance is collected in the filter cap 64, the filter cap 64 may be separated from the pulsator 60, and then the collected foreign substances may be discarded, thereby maintaining good hygiene.

Referring to FIGS. 1 to 5, the washing machine according to an embodiment of the present invention may include the centrifugal blade unit 80 and the guide unit 70. The centrifugal blade unit 80 may be rotatably disposed inside the pulsator 80 to spout washing water introduced between the tub 20 and the drum 30 by a centrifugal force during the rotation. The guide unit 70 may be disposed independently of the rotation of the centrifugal blade unit 80, and may guide water spouted by the centrifugal blade unit 80 to the spouting outlet 61*h* of the pulsator 60.

Particularly, the centrifugal blade unit 80 may form a spouting pressure by a centrifugal force during the rotation thereof to forcedly transfer washing water to a radially outward direction. In this case, the water stream pressurized by the centrifugal blade unit 80 may flow along the guide unit 70 and be guided to a central portion of the pulsator 60 in traveling direction.

Referring to FIGS. 3 and 4, the centrifugal blade unit 80 may include an upper surface 82, a lower surface 81 having an inlet 83 at the central portion thereof, and a plurality of rotational blades 84 extending between the upper surface 82 and the lower surface 81 in a radial direction. The upper surface 82 and the plurality of rotational blades 84 may be integrally formed.

Here, the integral forming may not only mean that the upper surface 82 and the rotational blade 84 may be injection-molded into one component, but may also mean that the upper surface 82 and the rotational blade 84 are injection-molded into individual components and then the upper surface 82 is coupled to the upper end of each rotation blade 84 by thermal fusion.

More specifically, the centrifugal blade unit 80 may include a hub 85, a plurality of rotational blade 84, a lower surface 81, an upper surface 84, and an outer partition wall 86. Hereinafter, the hub 85 and the outer partition wall 86 that have not mentioned above will be described below. The hub 85, which is for connection with the washing shaft 52, may have a central portion penetrated by the washing shaft 52. The outer partition wall 86 may connect wing ends 84*a* of the plurality of rotational blades 84. Washing water may be spouted through an opening 87 that are surrounded by a pair of rotational blades 84 adjacent to each other, a circumference of the upper surface 82, and the outer partition wall 86.

Here, the hub 85, the lower surface 81, the plurality of rotational blade 84, and the outer partition wall 86 may be integrally formed in one component by injection-molding, but the upper surface 82 may be separately injection molded, and then the upper surface 82 may be coupled to the upper end of each rotational blade 84 by thermal fusion.

The centrifugal blade unit 80 may be coupled to the washing shaft 52 through the hub 85. Accordingly, the centrifugal blade unit 80 and the pulsator 60 may be together rotated by the driving motor 50. Washing water may be pressurized in a circumferential direction of the centrifugal blade unit 80 by a centrifugal force due to the rotation of the centrifugal blade unit 80.

The tub 20 may be filled with washing water. Also, the drum 30 may have a plurality of through holes at the side surface thereof, allowing washing water to move between the drum 30 and the tub 20. Referring to FIG. 2, the drum 30 may include a lower surface 31 and a hub 32. The lower surface 31 may be formed to have a ring shape with an opening at a substantially central portion thereof, and the hub 32 may be rotated by the spinning shaft 51 and may be coupled to the lower side of the lower surface 31. Particularly, the hub 32 may have a plurality of communicating holes 32*h* spaced from each other along the circumferential direction thereof. When the centrifugal blade unit 80 rotates, water between the tub 20 and the drum 30 may be guided to the inlet 83 through the communicating hole 32*h*, and thus, washing water of the tub 20 may flow into the inner side of the centrifugal blade unit 80 through the communicating hole 32*h* and the inlet 83.

Figure 9:
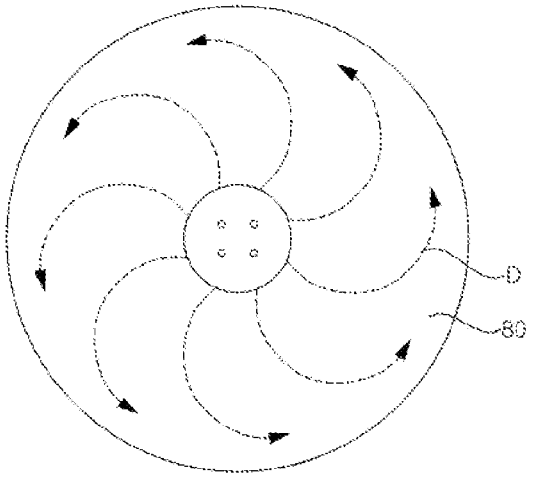
FIG. 9 is a schematic view illustrating a path of water stream pressurized in a circumferential direction while water stream is being spouted through a pulsator.

As describe above, washing water may be pressurized in the circumferential direction by a centrifugal force due to the rotation of the centrifugal blade unit 80. When viewed from the outside, the water stream induced by the rotational blade 84 may spirally move in the circumferential direction as shown in FIG. 9. That is, the water stream generated by the centrifugal blade unit 80 may have the flow characteristics of rotation direction.

On the other hand, a pressure difference may be generated between at the communicating hole 32*h* and the inlet 83 by pressurization of the circumferential direction during the rotation of the centrifugal blade unit 80. Accordingly, washing water between the tub 20 and the drum 30 may be guided from the communicating hole 32*h* to the inlet 83 by the water pressure.

The guide unit 70 may be disposed independently of the rotation of the centrifugal blade unit 80, and may guide washing water spouted by the centrifugal blade unit 80 to the spouting outlet 61*h* of the pulsator 60. Particularly, the guide unit 70 may form a water stream pressurized by the centrifugal blade unit 80 into a direct stream, and then may allow the water stream to be spouted through the pulsator 60 Referring to FIG. 2, the centrifugal blade unit 80 may be disposed under the guide unit 70. That is, the guide unit 70 may be disposed between the pulsator 60 and the centrifugal blade unit 80. The guide unit 70 may have a diameter greater than that of the centrifugal blade unit 80 such that the centrifugal blade unit 80 can be sufficiently covered by the guide unit 70.

Referring to FIG. 4, the guide unit 70 may include a body 71, a discharge port 72 formed at the central portion of the body 71, and a plurality of guide blades 73 protruding toward the centrifugal blade unit 80 around the discharge port 72 and extending along the radial direction.

Water stream pressurized in a circumferential direction by the centrifugal blade unit 80 may be induced into a direct stream by the guide blade 73, and may be discharged through the discharge port 72. That is, washing water may be discharged while being pressurized and rotated in a circumferential direction between the upper surface 82 and the lower surface 81 of the centrifugal blade unit 80.

Here, referring to FIG. 2, the guide unit 70 may be formed to surround the upper and lateral side surfaces of the centrifugal blade unit 80. Accordingly, the water stream discharged from the opening 87 of the centrifugal blade unit 80 may be guided along the rear surface of the body 71 of the guide unit 70.

Meanwhile, the plurality of guide blades 73 may protrude toward the centrifugal blade unit 80 around the discharge port 72, and may extend along the radial direction. Accordingly, the water stream discharged from the opening 87 of the centrifugal blade unit 80 may be guided to the discharge port 72 along the guide blade 72.

As describe above, the centrifugal blade unit 80 and the pulsator 60 may be together rotated by the driving motor 50. However, the guide unit 70 may be fixed on the drum 30, and may be independent of the rotation of the centrifugal blade unit 80 and the pulsator 60. That is, the guide unit 70 may be fixed on the lower surface 31 to be rotated together with the drum 30, but may be rotated independently of the pulsator 60 and the centrifugal blade unit 80. During the spinning cycle, when the spinning shaft 51 is connected to the rotor of the driving motor 50 by the clutch and thus the drum 30 and the pulsator 60 together rotate during the spinning cycle, the guide unit 70 may rotate together with the centrifugal blade unit 80 and the pulsator 60. However, during the washing cycle, the guide unit 70 may be independent of the rotation of the centrifugal blade unit 80 and the pulsator 60.

Accordingly, as described above, a water stream with whirling characteristics discharged by the centrifugal blade unit 80 may be induced by the guide blade 73 of the guide unit 70 into a direct stream. The water stream converted into the direct stream may be spouted into the drum 30 through the spouting outlet 61*h* of the pulsator 60.

In an aspect of the above-mentioned configuration, the guide unit 70 fixed with respect to the drum 30 independently of the centrifugal blade unit 80 rotating together with the pulsator 60 may be provided to allow the water stream pressurized by a centrifugal force due to the rotation of the centrifugal blade unit 80 to be converted into the direct current with a strong spouting pressure by the guide unit 70.

The water stream that is whirling may have the characteristics of expanding to the surroundings by the centrifugal force. Accordingly, it may be difficult to form a strong spouting pressure of a vertical direction like the direct stream. Accordingly, the above-mentioned configuration may have an effect of forming a spouting water stream with a strong spouting pressure while simplifying the structure.

Washing water inside the drum 30 may form a whirling water stream due to the rotation of the pulsator 60, and thus the water level at the inner wall of the drum 30 tends to become higher than that at the central portion. Referring to the left drawing of FIG. 7, based on a certain reference line A, the water level line B becomes higher from the central portion of the drum 30 to the outer side of the drum 30 along the radial direction due to the rotation of the pulsator 60.

In this case, when a small amount of washing water is used, the laundry may be exposed to the air at the central portion of the drum 30, or may be abraded by a frictional force. Furthermore, since washing water flows between the drum 30 and the tub 20, washing water may flow out from the inner side to the outer side of the drum 30. Accordingly, the water level of washing water inside the drum 30 may become more lowered or uneven.

According to the configuration of this embodiment, a water stream spouted through the pulsator 60 at a strong spouting pressure may compensate for the water level at the central portion of the drum 30 as shown in the right drawing of FIG. 6. Due to the increase of the water level at the central portion of the drum 30, the water level line C of washing water inside the drum 30 can approach the reference line A. Furthermore, since washing water can flow into the centrifugal blade unit 80 through the inlet 83 and then be spouted into the drum 30 by a water pressure difference due to the rotation of the centrifugal blade unit 80, the water level between the drum 30 and the tub 20 may be lowered while the water level inside the drum 30 increases, thereby sufficiently wetting the laundry with only a small amount of washing water. Also, since the balance of the water level of washing water inside the drum 30 is maintained, the abrasion of the laundry can be reduced.

In addition, the present invention has an effect of untangling twisted laundry by allowing a water stream spouted from the pulsator 60 to be converted into a direct stream. The laundry inside the drum 30 may be twisted by the whirling water stream. However, when the twisted laundry contacts the direct stream, the rotation of the laundry may be reduced and thus the laundry can be untangled.

Figure 8:
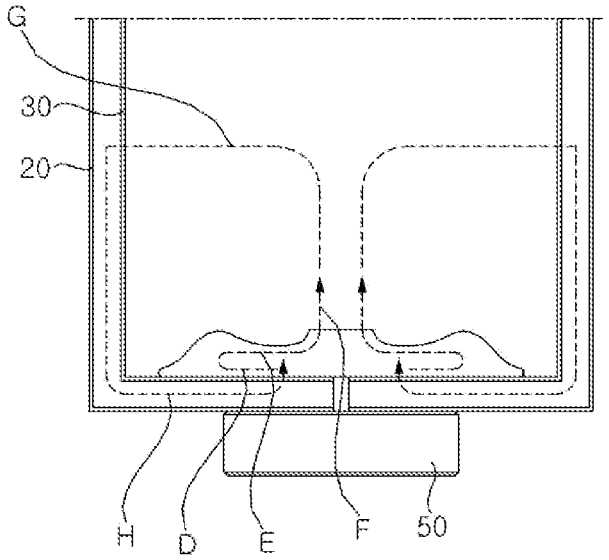
FIG. 8 is a schematic view illustrating a circulating path of washing water while water stream is being spouted through a pulsator.

FIG. 8 shows a circulation path of washing water inside the drum 30 and the tub 20 by a water stream generation unit. A water stream E guided along the guide blade 73 of the guide unit 70 may be spouted into the drum 30 (F). In this case, the water stream E may have a substantially straight tendency. Washing water inside the drum 30 may be moved to the tub 20 by the water stream formed due to the rotation of the pulsator 60 (G). Washing water moved to the tub 20 may be again introduced into the drum 30 by a water pressure difference generated by the centrifugal blade unit 80 (H). A whirling water stream D pressurized along a radial direction by the rotation of the centrifugal blade unit 80 may be converted into a direct stream by the guide unit 70. In this case, the water stream D pressurized and discharged by the centrifugal blade unit 80 may form a spirally whirling water stream as shown in FIG. 9, but may be converted into a direct stream by the guide unit 70. Accordingly, since a water stream with a strong spouting pressure is formed, the circulation of washing water inside the drum 30 can be facilitated, and furthermore, the circulation of detergents put into the drum 30 can be further facilitated, thereby improving the washing performance.

Figure 10:
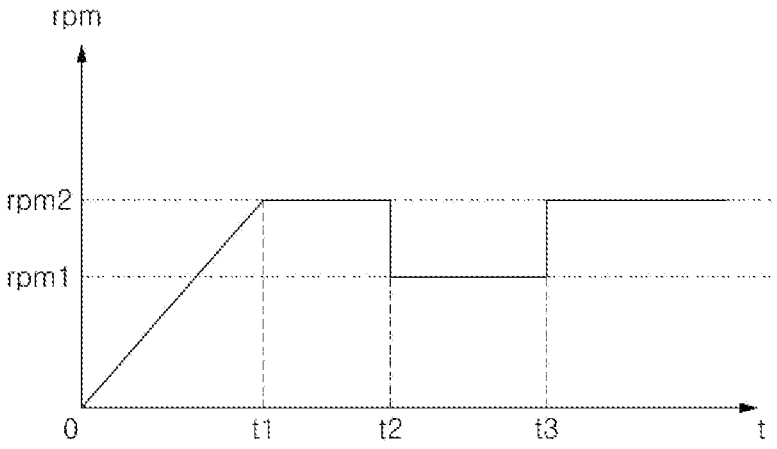
FIG. 10 is a view illustrating a washing method according to an embodiment of the present invention.

FIG. 10 is a view illustrating a washing method according to an embodiment of the present invention. Referring to FIG. 10, a washing method according to an embodiment of the present invention may include a first water supply of supplying water together with detergents, a first wash of performing washing when the first water supply is completed, a second water supply of additionally supplying water, and a second wash of performing washing when the water level is increased due to the second water supply (the concentration of detergents is lower than that of the first supply).

During the first wash and the second wash, the driving motor 50 may rotate so as to rotate the drum 30 or the pulsator 60.

Figure 7:
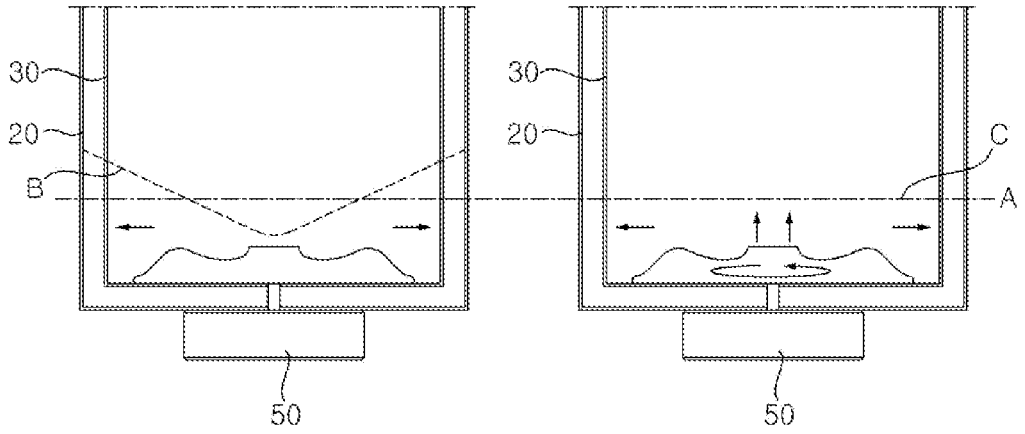
FIG. 7 is a view illustrating a comparison between a water level inside a drum during a rotation of a pulsator and a water level inside the drum complemented by a water stream spouting action of the pulsator.

Referring to FIG. 10, the driving motor 50 may be accelerated for the first wash ([0,t1]), and when the rotation speed reaches rpm2, the driving motor 50 may be controlled to maintain a constant speed for a certain time ([t1, t2]). In this case, a water stream may be spouted through the pulsator 60 at the section [t1, t2] in which the first wash is performed. As described above, the spouting of water stream may be performed by the rotation of the centrifugal blade unit 80. As shown in FIG. 7, the attenuation of detergents may be actively performed by the circulation of the water stream during the spouting of the water stream through the pulsator 60.

Thereafter, when the water level is raised by the second water supply, the second wash may be performed ([t2, t3]). In the second wash, the driving motor 50 may rotate at a lower speed rpm1 than that of the first wash, but the present invention is not limited thereto. In FIG. 10, the rotation speed rpm2 may be construed as a sufficient speed to induce the spouting of the water stream through the pulsator 60. Accordingly, the rotation speed rpm 2 is not necessarily greater than the speed in the second wash, and on the contrary, the rotation speed in the second wash is also not necessarily smaller than the speed in the first wash.

The spouting of the water stream through the pulsator 60 may also be performed to untangle the laundry inside the drum 30 after the second wash. For example, as shown in FIG. 9, the driving motor 50 may be controlled at the rotation speed rpm2 for a certain time after the second wash is completed (after t3).

The washing method according to this embodiment can facilitate the dissolution of detergents by spouting the water stream through the pulsator 60 at a low water level of an initial washing stage and thus inducing the circulation of washing water. Also, after the wash cycle of the laundry through the rotation of the drum 30 or the pulsator 60, a water stream may be again spouted to untangle the laundry twisted during the wash cycle. Thus, a next cycle such as a rinse cycle or a spin cycle can be performed while the laundry is being evenly distributed.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine comprising:

a tub to contain washing water;

a drum rotatably disposed in the tub;

a pulsator rotatably disposed inside the drum and including a spouting outlet;

a centrifugal blade unit rotatably disposed under the pulsator to spout the washing water introduced between the tub and the drum by a centrifugal force;

a guide unit disposed independently of the rotation of the centrifugal blade unit to guide washing water spouted by the centrifugal blade unit to the spouting outlet of the pulsator; and a filter cap to collect foreign substances floating in the washing water spouted through the spouting outlet, wherein the centrifugal blade unit comprises:

a lower surface part having an inlet formed therein, the inlet receives washing water between the tub and the drum;

a plurality of rotational blades disposed on the lower surface and extending along a radial direction; and an upper surface part covering an upper side of the blades except an opening between the plurality of blades adjacent to each other to spout the washing water, and wherein the guide unit comprises:

a body disposed at an upper side of the centrifugal blade unit and having a discharge port communicating with the spouting outlet of the pulsator; and a plurality of guide blades protruding from the body and guiding washing water spouted through the opening of the centrifugal blade unit to the discharge port.

2. The washing machine of claim 1, further comprises a check valve to open or close the spouting outlet according a washing stream discharged through the discharge port.

3. The washing machine of claim 2, wherein the check valve closes the spouting outlet at a falling location and opens the spouting outlet at a rising location.

4. The washing machine of claim 3, wherein the pulsator has a seating groove on which the check valve is seated at a location where the spouting outlet is closed.

5. The washing machine of claim 4, wherein the check valve has an outer inclination surface formed along an outer circumference seated in the seating groove, and the seating groove has a seating surface corresponding to the outer inclination surface.

6. The washing machine of claim 4, wherein the check valve forms a ring shape with an opening at a central portion thereof, an inner circumference and an outer circumference of the check valve is supported by the seating groove, and the check valve has an outer inclination surface formed along the outer circumference and an inner inclination surface formed along the inner circumference, and wherein the seating groove has an outer seating surface and an inner seating surface corresponding to the outer inclination surface and the inner inclination surface, respectively.

7. The washing machine of claim 2, wherein the check valve has a larger specific gravity than the washing water.

8. The washing machine of claim 1, wherein the pulsator comprises a flow passage forming portion to form a flow passage in which washing water forcedly transferred by the water stream generation unit flows toward the spouting outlet, and the filter cap is detachably coupled to the flow passage forming portion.

9. The washing machine of claim 1, wherein the filter cap has a plurality of through holes formed therein to filter foreign substances.

10. The washing machine of claim 1, wherein the plurality of guide blades are radially disposed so as to converge in a direction toward the discharge port.

11. The washing machine of claim 1, wherein the guide unit is fixedly disposed in the drum.

12. The washing machine of claim 1, wherein the upper surface part is coupled to upper ends of each of the plurality of rotational blades.

13. The washing machine of claim 12, wherein the plurality of rotational blades and the upper surface part are integrally formed into one body by thermal fusion.

14. The washing machine of claim 1, wherein the centrifugal blade unit further comprises an outer partition wall that connects wing ends of the plurality of blades.

15. The washing machine of claim 14, wherein the lower surface part, the outer partition wall, and the plurality of rotational blades are integrally formed into one body by injection-molding, and the upper surface part is injection-molded separately from the one body and then is coupled to upper ends of each of the plurality of rotational blades by thermal fusion.

16. The washing machine of claim 14, wherein the opening of the centrifugal blade unit is defined by a region that is surrounded by a pair of rotational blades adjacent to each other, an outer front end of the upper surface part, and the outer partition wall.

17. The washing machine of claim 1, wherein the plurality of guide blades protrude from a rear surface of the body and extend along a radiation direction.

18. The washing machine of claim 17, wherein the plurality of guide blades are radially disposed so as to converge in a direction toward the discharge port.

19. The washing machine of claim 17, wherein the plurality of guide blades extend in a straight line.

20. The washing machine of claim 1, further comprising;

a hub coupled to a lower part of the drum, wherein the hub has a plurality of communication holes such that washing water between the tub and the drum flows into the drum.

21. A washing machine comprising:

a tub to contain washing water;

a drum rotatably disposed in the tub;

a pulsator rotatably disposed inside the drum and including a spouting outlet;

a water stream generation unit disposed under the pulsator to from a water stream spouted through the spouting outlet;

a filter cap to collect foreign substances floating in the washing water spouted through the spouting outlet; and a check valve disposed in the filter cap and configured to be movable in a vertical direction according to the water stream spouted through the spouting outlet, wherein the check valve closes the spouting outlet at a falling location and opens the spouting outlet at a rising location, wherein the pulsator has a seating groove on which the check valve is seated at a location where the spouting outlet is closed, wherein the check valve forms a ring shape with an opening at a central portion thereof, an inner circumference and an outer circumference of the check valve is supported by the seating groove, and the check valve has an outer inclination surface formed along the outer circumference and an inner inclination surface formed along the inner circumference, and wherein the seating groove has an outer seating surface and an inner seating surface corresponding to the outer inclination surface and the inner inclination surface, respectively.

* * * * *